United States Patent [19]

Mazzorana

[11] 4,283,961

[45] Aug. 18, 1981

[54] ACTUATOR OF AN ELECTRICAL STARTER

[75] Inventor: Alfred B. Mazzorana, Venissieux, France

[73] Assignee: Societe de Paris et du Rhone, Lyon, France

[21] Appl. No.: 24,211

[22] PCT Filed: Jul. 19, 1978

[86] PCT No.: PCT/FR78/00013

§ 371 Date: Mar. 19, 1979

§ 102(e) Date: Mar. 19, 1979

[87] PCT Pub. No.: WO79/00061

PCT Pub. Date: Feb. 22, 1979

[30] Foreign Application Priority Data

Jul. 25, 1977 [FR] France ..... 77 23826

[51] Int. Cl.[3] ..... F02N 11/02

[52] U.S. Cl. ..... 74/6; 74/7 A; 74/104

[58] Field of Search ..... 74/6, 7 R, 7 A, 104; 192/98

[56] References Cited

U.S. PATENT DOCUMENTS

| | | | |
|---|---|---|---|
| 1,091,136 | 3/1914 | Hilt | 74/104 |
| 1,609,741 | 12/1926 | Taylor | 192/98 X |
| 1,626,427 | 4/1927 | Reed | 192/98 X |
| 2,872,823 | 2/1959 | Spencer | 74/6 |
| 3,401,779 | 9/1968 | Puidokas | 192/98 |

FOREIGN PATENT DOCUMENTS

| | | | |
|---|---|---|---|
| 1091477 | 10/1954 | France | 74/7 A |
| 2091566 | 1/1972 | France . | |

*Primary Examiner*—Allan D. Herrmann
*Attorney, Agent, or Firm*—Dowell & Dowell

[57] ABSTRACT

A lever for controlling the actuator of an electrical starter, for internal combustion engine, the connection between each friction block and the corresponding arm of a fork of the lever of the starter actuator being made by means of the ends of a single elastic stirrup member which is a part separate from said lever.

5 Claims, 3 Drawing Figures

ACTUATOR OF AN ELECTRICAL STARTER

The present invention relates to improvements in the fixing of friction bearing blocks of the actuator of an electrical starter with respect to the ends of its control lever.

It is an object of the invention to produce a device ensuring a rapid and economical assembly of the blocks in question.

According to the invention, each of the arms of the fork of the lever controlling the actuator of an electrical starter is with a friction block member by means of the end of a wire stirrup, which is retained by the corresponding arm due to the tension exerted on this stirrup by hook means which are part of the lever.

The invention will be more readily understood on reading the following description with reference to the accompanying drawings, in which.

Figure 1:
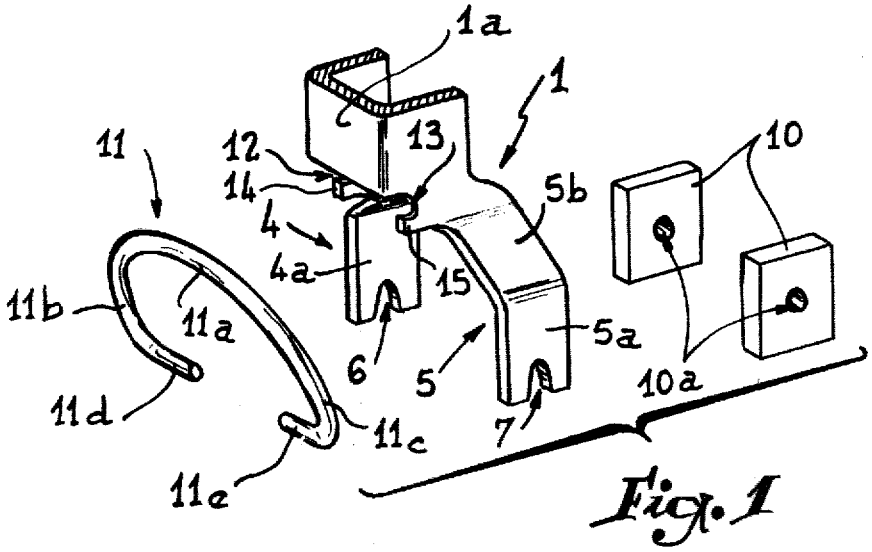
FIG. 1 is an exploded view of the different members constituting the lower part of the control lever of the actuator of an electrical starter.

Referring now to the drawings, FIG. 1 shows the lower part of a lever 1 intended to achieve the axial displacement of the actuator 2 (FIG. 2) of an electrical starter with respect to a shaft 3 which carries the armature of its electric drive motor. The end in question of the lever 1 is made in the form of a fork of which the two arms 4, 5 are adapted to straddle part of the actuator 2. In the example shown, the lever is made from a sheet metal blank folded so that the two arms 4, 5 are in the form of a flat section suitably bent to constitute two vertical parts 4*a*, 5*a* connected to the body 1*a* of the lever by an oblique element 4*b*, 5*b*. It will be noted that the end of each of the vertical parts 4*a*, 5*a* is provided with a notch 6 and 7, respectively, which is downwardly open.

Figure 2:
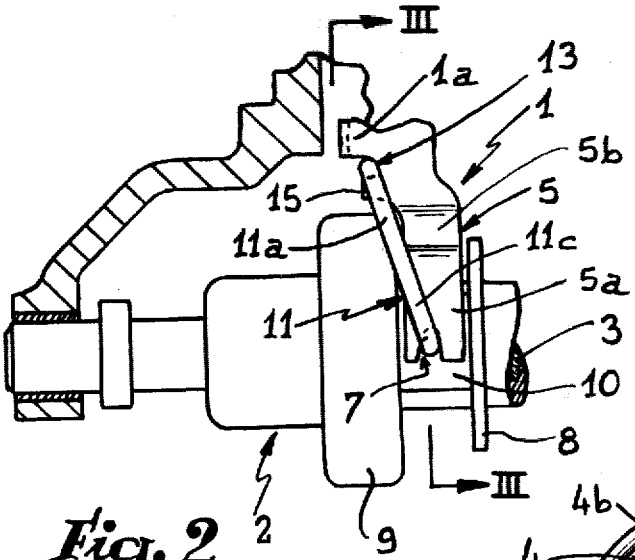
FIG. 2 is a partial view, on a smaller scale, of the nose of a starter comprising a device according to the invention.

As shown more particularly in FIG. 2, the oblique elements 4*b*, 5*b* are of such shape that the parts 4*a*, 5*a* of the arms are offset with respect to the body 1*a* of the lever. It will be noted that the arms 4 and 5 of the fork are conventionally engaged between a flange 8 and the axially sliding wheel 9 of the actuator 2. The cooperation between the arms of the fork and the actuator is effected via friction pieces in the form of parallelepipedic blocks 10 (FIG. 1) and which are made of a material having a low coefficient of friction.

The blocks 10 are placed inside the vertical parts 4*a*, 5*a* of the arms 4 and 5, in which position they are maintained according to the invention via a stirrup member 11 formed by means of a suitably shaped steel wire.

Figure 3:
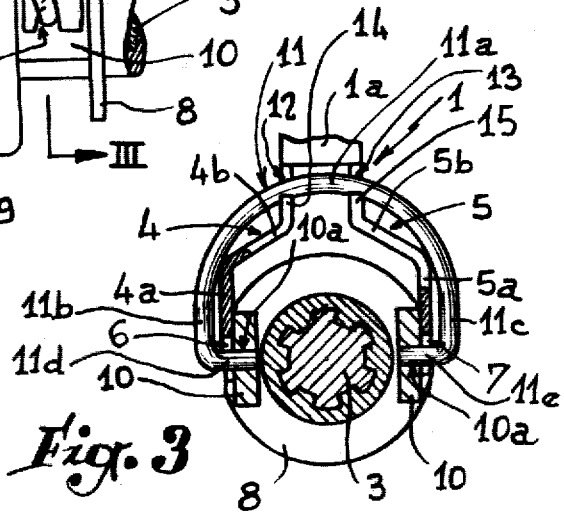
FIG. 3 is a transverse section thereof along III—III of FIG. 2.

As shown in FIG. 3, the stirrup 11 takes the general shape of a semi-circle 11*a* comprising a body portion having parallel extensions 11*b*, 11*c* each followed by a pivot portion 11*d*, 11*e* determining with said extensions an angle of 90° so that the two pivots are aligned face to face.

As shown in the Figures, the sides of the body 1*a* of the lever 1 are each provided with a horizontally oriented notches 12, 13 which determine hooks 14, 15 respectively, slightly raised upwardly.

The pivots 11*d*, 11*e* of the stirrup 11 are intended to pass through the notches 6, 7 respectively, to be engaged in a central perforation 10*a* of each block 10. The stirrup 11, having been positioned with its members 11*d* and 11*e* in the notches 6 and 7 of the arms 4, 5 of the lever 1, is deformed upwardly, pulling its pivot members against the inclined faces of each of the notches 6, 7 as the stirrup is clipped behind the hooks 14, 15 by engaging it in the corresponding notches 12, 13. After final positioning of the stirrup, these pivot members 11*d*, 11*e* are of such length as not to project inwardly beyond the blocks 10 so that they do not come into contact with the surface of the actuator (FIGS. 2 and 3).

I claim:

1. In an electrical starter for an internal combustion engine, the starter having a shaft supporting an axially slidable actuator, and having a lever forked to provide two arms straddling the actuator, and each arm carrying a friction block disposed to contact the actuator to displace it axially, an improved means for attaching the friction blocks to the arm wherein each block has a hole extending into it and oriented normal to the shaft, each block being located inside of an arm between the arm and the actuator, and a wire stirrup member having two mutually aligned pivot portions comprising the ends of the wire and joined by a curved body portion, said arms each having an opening therethrough receiving one of said end pivot portions which portions respectively pass through the arms and into the holes in the blocks, and means on the lever to retain the body portion of the stirrup.

2. In a starter as claimed in claim 1, said aligned pivot portions being oriented perpendicularly to said arms, and the opening in each arm comprising a notch in the end of the arm opening away from the lever and away from said means on the lever to retain the body portion of the stirrup.

3. In a starter as claimed in claim 2, said means to retain the body of the stirrup comprising hook means on the lever to receive and retain the body portion of the stirrup.

4. In a starter as claimed in claim 3, the hook means on the lever being spaced from said notches on the arms by a distance which is greater than the distance from the center of the body portion of the stirrup to its pivot portions, whereby the stirrup is tensioned when held in said notches by said hook means.

5. In a starter as claimed in claim 4, said hook means comprising two hooks projecting from the lever where each arm is joined thereto.

* * * * *